US008539961B2

(12) United States Patent
Gaugler

(10) Patent No.: US 8,539,961 B2
(45) Date of Patent: Sep. 24, 2013

(54) HAIR CUTTING COMB WITH T-TOP MEMBER

(76) Inventor: Donald Gaugler, New York, NY (US)

( * ) Notice: Subject to any disclaimer, the term of this patent is extended or adjusted under 35 U.S.C. 154(b) by 1055 days.

(21) Appl. No.: 11/890,120

(22) Filed: Aug. 3, 2007

(65) Prior Publication Data

US 2009/0032043 A1 Feb. 5, 2009

(51) Int. Cl.
*A45D 24/34* (2006.01)
*B26B 21/12* (2006.01)

(52) U.S. Cl.
USPC ..... 132/213; 132/126; 30/30

(58) Field of Classification Search
USPC ..... 132/213, 213.1, 219, 104, 126, 129, 132/136, 137, 139, 142, 147, 148; 30/30, 30/31, 53–55, 66, 67, 330
See application file for complete search history.

(56) References Cited

U.S. PATENT DOCUMENTS

| | | | | |
|---|---|---|---|---|
| D42,119 | S | | 1/1912 | Thompson |
| D51,832 | S | | 3/1918 | Bechtold |
| 1,789,234 | A | | 1/1931 | Keenan |
| 1,852,362 | A | | 4/1932 | Newby |
| 1,877,538 | A | | 9/1932 | Scheiwer |
| 1,950,667 | A | | 3/1934 | Fulton |
| 1,976,290 | A | | 10/1934 | Motley |
| 2,141,340 | A | | 12/1938 | Baumgarten |
| D123,079 | S | | 10/1940 | De Requesens |
| 2,256,326 | A | | 9/1941 | Quinio |
| 2,481,403 | A | | 9/1949 | Di Zazzo |
| D157,064 | S | | 1/1950 | Mansfield |
| 2,507,373 | A | | 5/1950 | Finkelstein |
| 2,512,289 | A | | 6/1950 | Scaeffer |
| 2,514,774 | A | | 7/1950 | Leedy |
| D161,784 | S | | 1/1951 | Palmer |
| 2,568,368 | A | | 9/1951 | Sayer et al. |
| D165,306 | S | | 11/1951 | Shaeffer |
| D166,407 | S | | 4/1952 | Nevelson |
| 2,620,559 | A | | 12/1952 | Verdi |
| 2,650,421 | A | * | 9/1953 | Wietzel ..... 30/30 |
| D209,851 | S | | 1/1968 | Levin |
| D211,443 | S | | 6/1968 | Tin |
| D219,501 | S | | 12/1970 | Trevor |
| D237,038 | S | | 10/1975 | Laurenti |
| 3,990,461 | A | | 11/1976 | Katz |
| 4,441,252 | A | | 4/1984 | Caves |
| 4,663,841 | A | | 5/1987 | Custer |
| 4,841,634 | A | | 6/1989 | Cho |
| 4,928,716 | A | | 5/1990 | Greene |

(Continued)

FOREIGN PATENT DOCUMENTS

GB 2 172 201 A 9/1986

OTHER PUBLICATIONS htp://replay.waybackmachine.org/19980206063516/http://www.dscott.com/comb.htm.*

(Continued)

*Primary Examiner* — Rachel Steitz
(74) *Attorney, Agent, or Firm* — Patrick J Walsh

(57) ABSTRACT

A hair tool is provided that includes a first member for housing at least one razor and a second member formed generally in the shape of the letter "T". The second member may be configured for matable attachment to the first member to resist ejection of the at least one razor from the first member.

5 Claims, 4 Drawing Sheets

(56) References Cited

U.S. PATENT DOCUMENTS

| | | | | |
|---|---|---|---|---|
| D311,069 | S | 10/1990 | Furco | |
| D333,764 | S | 3/1993 | Osvaldo | |
| 5,330,492 | A * | 7/1994 | Haugen | 606/167 |
| 5,461,780 | A | 10/1995 | Morana | |
| D364,939 | S | 12/1995 | Scott | |
| 5,502,860 | A | 4/1996 | Franke | |
| D389,651 | S | 1/1998 | Chan et al. | |
| 6,058,608 | A | 5/2000 | Wruck | |
| 6,094,820 | A * | 8/2000 | Adachi | 30/30 |
| 6,249,973 | B1 | 6/2001 | Hirano | |
| D452,982 | S | 1/2002 | Offer et al. | |
| D489,488 | S | 5/2004 | Gaugler | |
| 2004/0025897 | A1 | 2/2004 | Menaged et al. | |
| 2008/0235951 | A1 * | 10/2008 | Groh | 30/30 |

OTHER PUBLICATIONS

Contents of website, http://donaldscottny.com/products-page, as of Nov. 3, 2010.

* cited by examiner

HAIR CUTTING COMB WITH T-TOP MEMBER

FIELD OF THE INVENTION

Embodiments of the present invention relate generally to hair combs that include one or more razors for cutting hair, and more particularly, to hair cutting combs with a t-top member for retaining the razors during use.

BACKGROUND OF THE INVENTION

Hair tools are known that can both comb and cut hair. Generally, such hair tools include comb teeth for combing hair in a conventional manner. The hair tools also include a razor for cutting hair. Despite their usefulness, conventional hair tools are typically difficult and expensive to manufacture, and can be unsafe for end users.

In view of the foregoing, it would be desirable to provide improved hair cutting combs.

SUMMARY OF THE INVENTION

Embodiments of the present invention relate to hair cutting combs with a t-top member for retaining one or more razors during use. Hair cutting combs made according to some embodiments of the present invention are more cost-efficient to manufacture and safer for end users.

In an aspect, a hair tool is provided that includes a first member for housing at least one razor and a second member formed generally in the shape of the letter "T". The second member may be configured for matable attachment to the first member to resist ejection of the at least one razor from the first member.

In some embodiments, the first member may include comb teeth oriented substantially perpendicularly to a longitudinal axis of the first member. For example, the razor may extend from within a cavity of the first member to within the comb teeth. The razor may be exposed between at least two neighboring ones of the comb teeth to effect hair cutting. In some embodiments, a block out is provided between at least two neighboring comb teeth to prevent exposure of the razor and cutting of hair.

In some embodiments, the first member may include at least one component (e.g., a male or female member) configured for slidable engagement with a complimentary component of the second member. This may allow relative movement between the first and second members, for example, from a first state in which the first member and the second member are fully attached to a second state in which the first member and the second member are fully detached.

In still other embodiments, the second member may include a grip (e.g., one or more raised edges). The grip may facilitate an application of force by an end user that causes sliding of the second member relative to the first member.

In another aspect, a hair cutting comb is provided that includes a body member and a top member. The body member may include a hair tool with comb teeth extending substantially perpendicularly to a longitudinal axis of the body member. The body member may also form a cavity that is configured to receive at least one razor (e.g., two razors) via insertion of the at least one razor into an end of the body member in the direction of the longitudinal axis. The at least one razor may extend from an interior of the body member to within the comb teeth, such that at least a portion of the razor is exposed between at least two neighboring ones of the teeth. The body member may additionally form a channel that spans at least a substantial portion of the comb teeth and that is configured to receive the top member. The top member may include a first portion configured to cover the end of the body member. The top member may additionally include a second portion configured for slidable engagement with the channel of the body member, from a first state in which the first portion of the top member covers the end of the body member to a second state in which the first portion does not cover the end of the body member.

In some embodiments, the body member may include a second hair tool with comb teeth that extend substantially perpendicularly to the longitudinal axis of the body member. The comb teeth of the first hair tool and the comb teeth of the second hair tool may extend in opposite directions. In some embodiments, the first hair tool and the second hair tool may be a single, integral component (e.g., formed from plastic).

In some embodiments, the first portion of the top member may be oriented substantially perpendicularly to the second portion of the top member. In some embodiments, the top member may additionally include a grip. The first portion, the second portion, and the grip of the top member may be a single, integral component (e.g., formed from plastic).

In still other embodiments, the body member may include an elongate portion positioned below the hair tool along the longitudinal axis of the body member. The elongate portion may be a comb or a twisted handle.

In some embodiments, the body member may be configured to receive two, single-edged razors or one, double-edged razor. The razors may be make from metal and may comprise chromium tips.

In some embodiments, the body member may be configured to permit passage of the at least one razor partially but not all the way to the bottom of the cavity. Thus, in the second state in which the top member does not cover the end of the body member, this may cause a gap to be exposed between the bottom of the at least one razor and the bottom of the channel. The at least one razor can be ejected from the cavity of the body member by inserting a tool (e.g., a screwdriver or an edge of the t-top member after it is detached from the body member) into the gap and applying an upward force to the bottom of the at least one razor.

BRIEF DESCRIPTION OF THE DRAWINGS

For a better understanding of the present invention, including the various objects and advantages thereof, reference is made to the following detailed description, taken in conjunction with the accompanying illustrative drawings, in which like reference characters refer to like parts throughout, and in which.

DETAILED DESCRIPTION OF THE INVENTION

Figure 1:
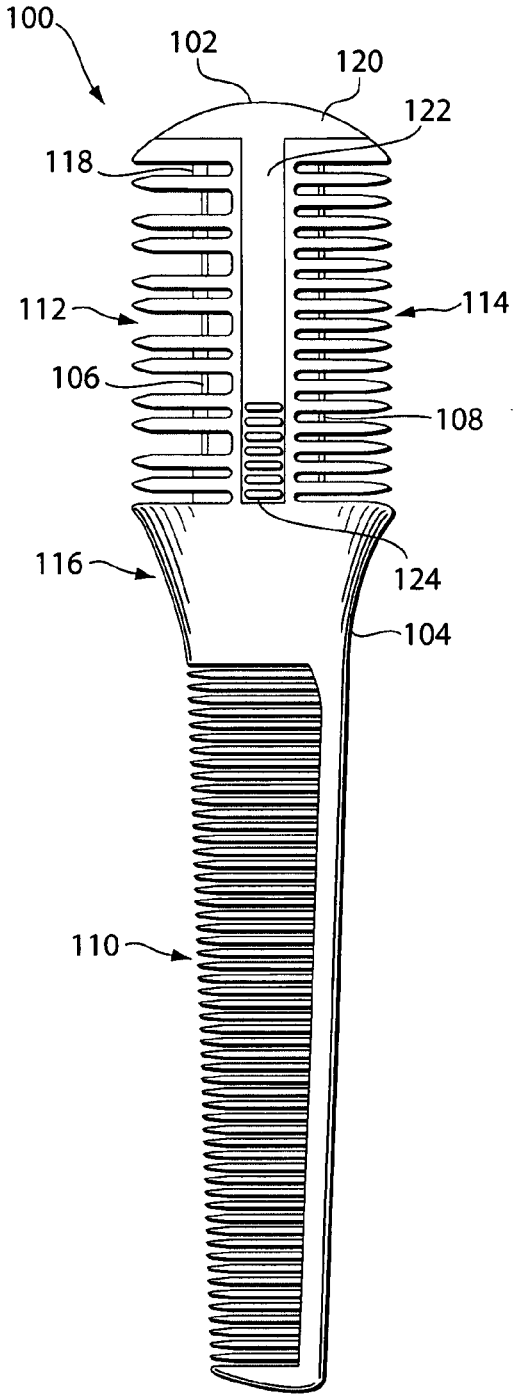
FIG. 1 is a front view of a hair cutting comb with a t-top member, according to some embodiments of the present invention.

FIG. 1 is a front view of a hair cutting comb 100 according to some embodiments of the present invention. Cutting comb 100 includes member 102 generally in the shape of the letter "T" (also referred to herein as a t-top member), body member 104, and razors 106 and 108. Body member 104 includes comb 110 and hair tools 112 and 114. Comb 110 is connected to hair tools 112 and 114 by neck 116. The blades of razors 106 and 108 extend outwardly from a cavity of body member 104 to within the comb teeth of hair tools 112 and 114, respectively. The exposure of the blades between the comb teeth provides a hair cutting capability. However, the positioning of the razors within the comb teeth and the separation of the comb teeth may guard against the cutting of larger objects such as the fingers of an end user.

Figure 2:
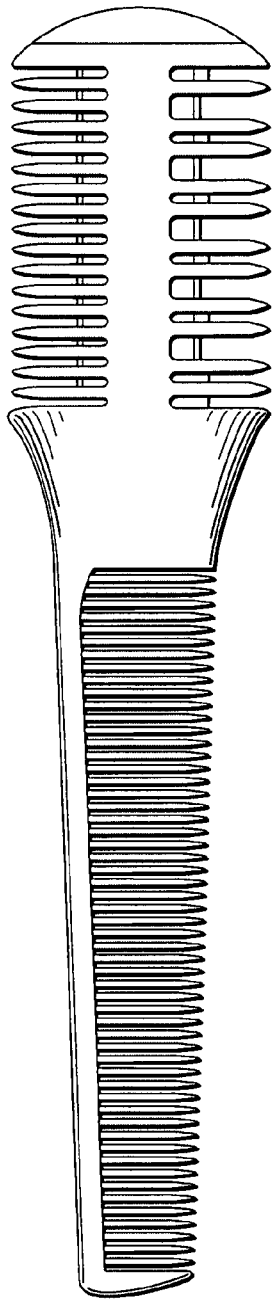
FIG. 2 is a back view of the hair cutting comb of FIG. 1.
Figure 3:
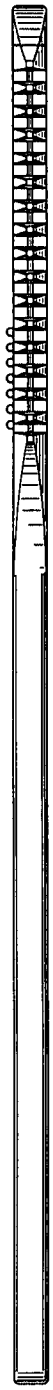
FIG. 3 is a right side view of the hair cutting comb of FIG. 1.
Figure 4:
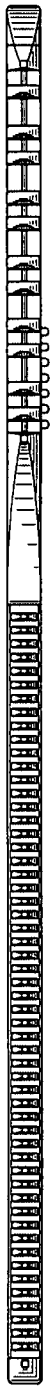
FIG. 4 is a left side view of the hair cutting comb of FIG. 1.

In some embodiments, the blades of razors 106 and 108 may extend only a portion (e.g., one third) of the way through the comb teeth. In some embodiments, one or both of hair tools 112 and 114 may include block outs 118 between the comb teeth, for example, in an alternating arrangement so that only alternating portions of hair is cut. In other embodiments, one of hair tools 112 and 114 may be a regular comb (e.g., similar to comb 110), a brush, or other hair tool. The comb teeth of hair tool 112 may extend toward the left side of cutting comb 100, whereas the comb teeth of hair tool 114 may extend toward the right side of cutting comb 100, or vice versa. The number and spacing of the comb teeth in FIG. 1 are only illustrative and modifications are fully contemplated as being within the scope of the present invention. FIG. 2 shows a back view of cutting comb 100. FIG. 3 shows a right side view of cutting comb 100. FIG. 4 shows a left side view of cutting comb 100.

Referring again to FIG. 1, t-top member 102 may be configured for attachment to and disconnection from body member 104. Detachment of t-top member 102 from body member 104 may expose a cavity of body member 104 configured to receive razors 106 and 108. Attachment of t-top member 102 to body member 104 may prevent razors 106 and 108 from ejecting from the cavity during use of cutting comb 100. T-top member 102 may include portion 120 that forms the top of cutting comb 100, and portion 122 which may be oriented generally perpendicularly to an axis of top portion 118. Portion 122 of t-top member 102 may be configured for slidable engagement and disengagement with body member 104. More specifically, in some embodiments, portion 122 may be insertable to, and removable from, a complimentary channel or other recess formed in body member 104. T-top member 102 (e.g., portion 122) may include one or more raised edges 124 and/or another grip mechanism to facilitate insertion and removal of member 102 to and from body member 104.

In the embodiment of FIG. 1, t-top member 102 includes an elongate portion 122 that extends along the entire length of hair tools 112 and 114 in a direction (i.e., along a longitudinal axis of body member 104) that is perpendicular to the comb teeth of portions 112 and 114. In other embodiments, portion 122 and the corresponding channel of body member 104 may be longer or shorter than the length of hair tool portions 112 and 114, and/or may have a different angular orientation relative to the comb teeth of portions 112 and 114. In some embodiments, portion 122 and the corresponding channel of body member 104 may span at least a substantial portion of the comb teeth (e.g., more than 1 comb tooth).

Hair cutting comb 100 and its various components may be made from any suitable material or combination of materials. In one embodiment, t-top member 102 (including top portion 120, elongate portion 122, and/or grip portion 124) may be a single, integral component made from, for example, plastic. Body member 104 (including comb 110, hair tool portion 112, hair tool portion 114, neck 116, and/or block out(s) 118) may also be a single, integral component made from, for example, the same or a different plastic. This two-piece construction may simplify the manufacturing process significantly. Razors 106 and 108 may be made from, for example, metal. In other embodiments, all or substantially all of the components of cutting comb 100 may be made from metal.

Figure 5:
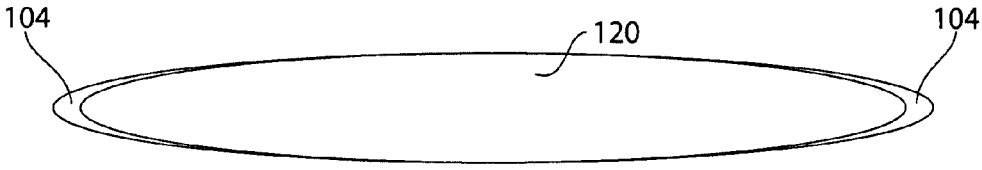
FIG. 5 is an enlarged, top view of the hair cutting comb of FIG. 1.

FIG. 5 is an enlarged, top view of hair cutting comb 100. Referring to both FIGS. 1 and 5, top portion 120 of t-top member 102 mates with adjacent surfaces of body member 104, and more specifically, the top portions of hair tools 112 and 114.

Figure 6:
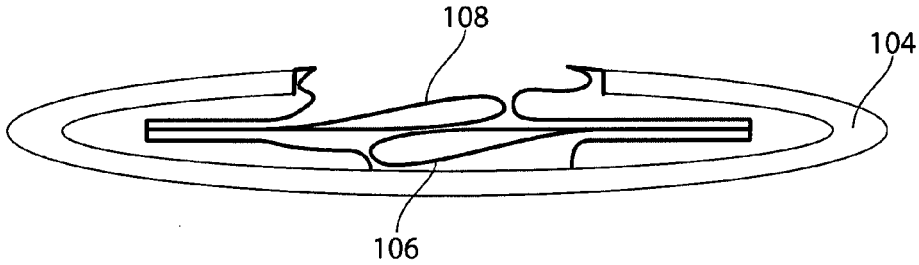
FIG. 6 is an enlarged, top view of the hair cutting comb of FIG. 1 after detachment of the t-top member.

FIG. 6 is an enlarged, top view of cutting comb 100 after detachment of t-top member 102 from body member 104. As shown, detachment of t-top member 102 exposes the cavity of body member 104 configured to receive razors 106 and 108.

Figure 7:
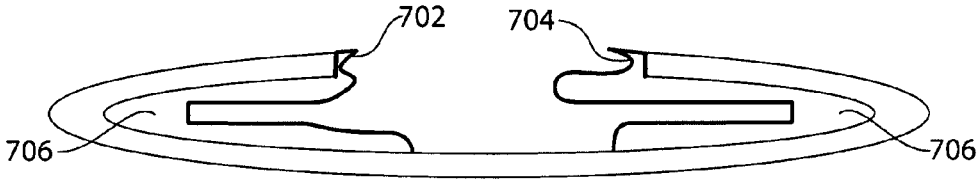
FIG. 7 is an enlarged, top view of the hair cutting comb of FIG. 1 after detachment of the t-top member and removal of the razors.

FIG. 7 is an enlarged, top view of cutting comb 100 after detachment of t-top member 102 and removal of razors 106 and 108 from the cavity of body member 104. The interior surfaces of body member 104 form opposed female members 702 and 704 (e.g., slots), which are configured to receive corresponding male members of t-top portion 122 (e.g., tabs). Slots 702 and 704 may span at least a portion (e.g., all or substantially all) of the channel of body member 104 that is configured to receive portion t-top portion 122. The interior surfaces of body member 104 also form recesses 706 that are configured to receive tabs of t-top portion 120.

Figure 8:
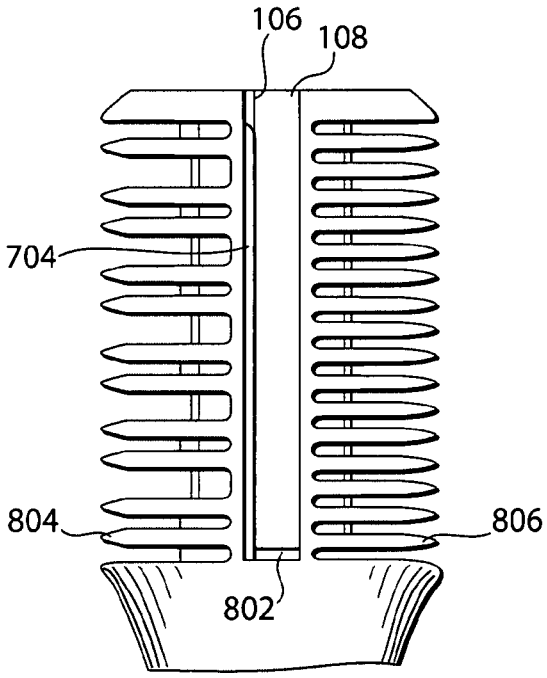
FIG. 8 is an enlarged, front view of the hair cutting comb of FIG. 1 after detachment of the t-top member.

FIG. 8 is an enlarged, front view of cutting comb 100 after detachment of the t-top member 102 from body member 104. As shown, removal of t-top member 102 from the channel formed in body member 104 exposes razor 108 and a portion of slot 704 (FIG. 7) formed by the interior of body member 104. In this embodiment, slot 704 does not extend along the top-most portion of the channel, and thus the top-most portion of razor 106 is also exposed. Removal of t-top member 102 from body member 104 also exposes gap 802 between the bottom of razors 106 and 108 and the bottom of the channel. This gap can be utilized to eject razors 106 and/or 108 from the cavity of body member 104. More specifically, whereas the comb teeth positioned above comb teeth 804 and 806 may have slots formed internally therein to permit passage of the blades razors 106 and 108 (see FIG. 6), comb teeth 804 and 806 (e.g., the bottom-most comb teeth of hair tool portions 112 and 114) may be configured to prevent passage of razors 106 and 108 any further down the cavity of body member 104. Thus, gap 802 may span the distance from at or about teeth 804 and 806 (which may be located at the same vertical position) to the bottom of the channel formed in body member 104. Razors 106 and/or 108 can be ejected from the cavity of body member 104 by inserting a tool (e.g., a screwdriver or an edge of t-top member 102 once member 102 is slid upwardly relative to body member 104) into gap 802 and applying an upward force to the bottom of the razor(s).

Figure 9:
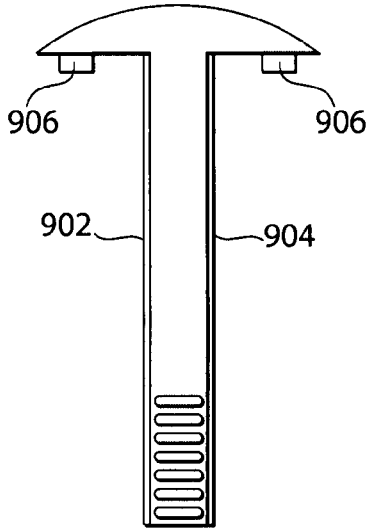
FIG. 9 is an enlarged, front view of the t-top member of FIG. 1.

FIG. 9 is an enlarged, front view of t-top member 102. T-top member 102 may include tabs 902 and 904 configured for receipt within slots 704 and 702, respectively, formed by the interior of body member 104 (FIG. 7). T-top member 102 may also include tabs 906 configured for receipt within recesses 706 (FIG. 7). Other mechanisms for matably attaching t-top member 102 to body member 104 are of course possible and are fully contemplated by the present invention. For example, in some embodiments, the interior surfaces of body member 104 may form at least one tab that is configured for matable attachment to a corresponding recess of t-top member 102.

Figure 10:
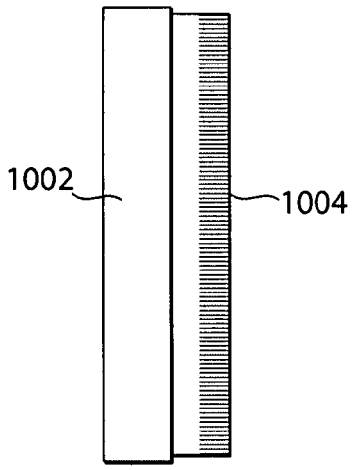
FIG. 10 is an enlarged, front view of a razor in accordance with some embodiments of the present invention.

FIG. 10 is an enlarged, front view of a razor according to some embodiments of the present invention, which includes a blunt, handle portion 1002 and a blade portion 1004. In some embodiments, blade portion 1004 may be chromium-tipped. The razor may be made from any other suitable material or combination of materials. One or two razors may be used within the cutting comb assembly of FIG. 1. In some embodiments, one, double-edged razor may be provided that is configured for receipt within the cavity of body member 104 and for use by hair tools 112 and 114.

Thus it is seen that a hair cutting comb with a detachable t-top member is provided. Although particular embodiments have been disclosed herein in detail, this has been done by way of example for purposes of illustration only, and is not intended to be limiting with respect to the scope of the appended claims, which follow. In particular, it is contemplated that various substitutions, alterations, and modifications may be made without departing from the spirit and scope of the invention as defined by the claims. For example, in some embodiments, comb 110 (FIG. 1) may be replaced with the twisted handle described in commonly-owned U.S. Design Pat. No. D489,488, which is hereby incorporated by reference herein in its entirety. Other aspects, advantages, and modifications are considered to be within the scope of the following claims. The claims presented are representative of the inventions disclosed herein. Other, unclaimed inventions are also contemplated. The applicant reserves the right to pursue such inventions in later claims.

What is claimed is:

1. A hair cutting comb comprising a body member and a top member in the shape of the letter T, the body member having a comb and a pair of hair tools, the comb having teeth extending substantially perpendicularly to a longitudinal axis of the body member, the body member further having a neck portion interconnecting comb and hair tools along the longitudinal axis, each hair tool having comb teeth, the teeth of one hair tool extending to the left side of the body member and the teeth of the other hair tool extending to the right of the body member, the body member having a cavity defined by slots formed within the hair tools teeth, the cavity exposed by an opening through the top of the body member, razors with blades extending outwardly from the cavity to within the comb teeth of hair tools, one or more hair tools comb teeth being substantially solid and defining the limit of passage of razors into the cavity, the body member further having an open channel along the longitudinal axis extending to the bottom of the cavity and past the substantially solid hair tool comb teeth, the portion of the channel past the solid teeth defining a hollow gap, the hollow gap exposing the lower ends of the razors situated within the teeth of hair tools, the top member having a first portion to cover the end of the body member and a second portion configured for slidable movement with the body member channel, the top member having a first position in which the first portion covers the end of the body member and the second portion fully covers the channel, and a second position in which the first portion uncovers the end of the body member and the second portion exposes the hollow gap for access to the lower ends of the razors whereby the razors can be ejected from the cavity of the body member by inserting a tool into the gap and applying an upward force to the bottom edges of the razors.

2. The hair cutting comb of claim 1, wherein the top member further comprises a grip for facilitating an application of force that causes sliding of the top member relative to the body member.

3. The hair cutting comb of claim 2, wherein the first portion, the second portion, and the grip of the top member are a single, integral component.

4. The hair cutting comb of claim 1 wherein the razors comprise single-edged razors.

5. The hair cutting comb of claim 1 wherein the razors comprise double-edged razors.

* * * * *